US005260677A

United States Patent [19]

Gamble

[11] Patent Number: 5,260,677

[45] Date of Patent: Nov. 9, 1993

[54] SNAP-ACTING NORMALLY CLOSED AC RELAY

[76] Inventor: John G. Gamble, 75 Library La., Simsbury, Conn. 06070

[21] Appl. No.: 927,596

[22] Filed: Aug. 10, 1992

Related U.S. Application Data

[63] Continuation-in-part of Ser. No. 787,060, Nov. 4, 1991, Pat. No. 5,155,458.

[51] Int. Cl.[5] ..... H01H 51/22

[52] U.S. Cl. ..... 335/78; 335/83; 335/128

[58] Field of Search ..... 335/78, 79, 80, 81, 335/82, 83, 84, 85, 86, 124, 128, 130, 131

[56] References Cited

U.S. PATENT DOCUMENTS 4,498,065 2/1985 Nagamoto et al. .
4,691,181 9/1987 Katsutani et al. .
4,937,544 6/1990 Mueller .
4,951,017 8/1990 Buchschmid et al. ..... 335/128
5,065,127 11/1991 Mitschir et al. ..... 335/128
5,095,294 3/1992 Chikira et al. ..... 335/78
5,155,458 10/1992 Gamble ..... 335/80

*Primary Examiner*—Lincoln Donovan
*Attorney, Agent, or Firm*—Chilton, Alix & Van Kirk

[57] ABSTRACT

A normally closed AC relay with a stator core with primary and shaded poles, a pivotal clapper, an elongated leaf spring fixed to the clapper providing a clapper return spring and a clapper overtravel spring extending radially outwardly from the outer end of the clapper, the overtravel spring being substantially narrower than the rest of the leaf spring to reduce the weight and moment of inertia of the overtravel spring and the complete clapper assembly, the overtravel spring having a spring rate significantly greater than the return spring and both the overtravel spring and clapper assembly having a natural frequency significantly greater than twice the frequency of the AC source so that the clapper is actuated to open the relay without incipient switch chatter.

16 Claims, 5 Drawing Sheets

SNAP-ACTING NORMALLY CLOSED AC RELAY

RELATED APPLICATION

The present application is a continuation-in-part of my copending application Ser. No. 787,060, filed Nov. 4, 1991, now U.S. Pat. No. 5,155,458 and entitled "Normally Closed At Relay".

BACKGROUND OF THE INVENTION

The present invention relates generally to AC relays and more particularly to AC electromagnetic relays of the type which are closed when deenergized and opened as the AC current ramps upwardly to a certain level and for example are operated by a solar photocell to automatically switch one or more outdoor lights off and on (by opening the relay when the solar light increases to a certain intensity and reclosing the relay when the solar light decreases to a certain intensity).

Photocell operated relays are commonly used for controlling street lights. To minimize the total system cost, a separate AC relay is customarily provided for each street light. Also, cost and other considerations dictate that a relay with a normally closed relay switch be used and the relay be connected to turn the light on when closed and off when open. Such an arrangement ensures that the light will be on when needed and permits using the light, if on in the daytime, to indicate a malfunction. Typically, the photocell is connected in series with the relay so that the AC voltage across the relay is dependent on the photocell resistance and thus the intensity of the light received by the photocell. As the light intensity increases, the relay current increases or ramps upwardly. As the light intensity decreases, the relay current decreases or ramps downwardly. The relay is opened when the relay current increases to a certain level and recloses when the relay current decreases to a certain lower level.

When a conventional, normally closed AC relay is operated by an upwardly ramping AC current as described, just before the AC current reaches the required level to open the relay, the relay armature can vibrate sufficiently to cause the mating contacts of the normally closed relay switch to chatter. Such incipient vibration and switch chatter is caused by the varying magnetic field across the working air gap of the relay and the resulting ripple actuating force. In a solar photocell controlled system, such incipient vibration and switch chatter can occur for a significant period of time due to the gradual increase in the solar light intensity to the level required to open the relay. Such incipient switch chatter can significantly reduce the operating life of the relay and outdoor light or other electrical device controlled by the relay. Some incipient switch chatter is permitted under the standards of acceptance of the OLC ("Outdoor Lighting Controls") industry—i.e., three contact breaks and restrikes are permitted within a period of fifty milliseconds. However, accepting that level of switch chatter is tantamount to accepting a reduced operating life of both the relay and outdoor light.

Attempts to prevent or minimize incipient switch chatter have included using nickel-iron alloys for all or part of the ferromagnetic structure of the relay to flatten the permeability curve of the ferromagnetic structure, in relationship to the relay current, at the current level of incipient switch break. However, nickel-iron alloy parts are very expensive in comparison to conventional soft iron parts due to both the higher cost of the material and the protracted annealing process required. Accordingly, nickel-iron alloy parts are typically made with a minimum of material and consequently are relatively weak structurally and highly sensitive magnetically. Such relay parts are therefore vulnerable to physical damage and loss of calibration, particularly where, as in some commercial relays, the working air gap is only a few thousandths of an inch.

SUMMARY OF THE INVENTION

A principal object of the present invention is to provide a new and improved AC relay of the type described which provides switch operation with reduced likelihood of switch chatter.

Another object of the invention is to provide a new and improved AC relay of the type described which may be economically manufactured to provide reliable and repeatable operation free of switch chatter.

A further object of the invention is to provide a new and improved AC relay of the type described having a rapid switch response time substantially less than a half-wave of the AC operating current.

A further object of the invention is to provide a new and improved AC relay of the type described having a pivotal clapper which, at the point that the relay contacts break to open the relay, is sufficiently responsive to open the relay with little or no incipient switch chatter.

Another object of the invention is to provide a new and improved AC relay of the type described having one or more of the foregoing benefits without resort to using special ferromagnetic alloys such as nickel-iron alloys for all or part of the ferromagnetic structure of the relay.

It is another object of the invention to provide a new and improved AC relay of the type described having a more rugged construction which is less vulnerable to physical damage during handling and shipping and which retains its initial calibration during a long operating life.

Other objects and advantages of the invention will become apparent from the drawings and the specification.

DETAILED DESCRIPTION OF THE PREFERRED EMBODIMENTS

Figure 1:
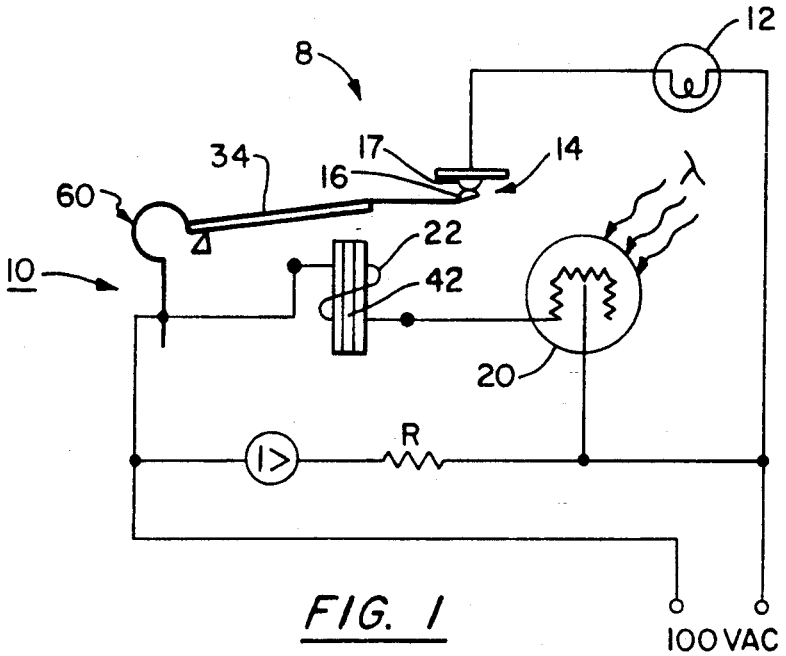
FIG. 1 is a schematic diagram of a control circuit employing an AC relay incorporating an embodiment of the present invention.

In the drawings, like numerals represent the same or like parts. FIG. 1 shows a control circuit 8 which employs an AC relay 10 incorporating an embodiment of the present invention. The AC relay 10 has a normally closed relay switch 14 with mating switch contacts 16, 17 for controlling the operation of an outdoor light 12. The relay 10 is operated by a suitable light receiving photocell 20 having a resistance which decreases as the intensity of the received light increases. The control circuit 8 is designed to be connected to any standard 110 volt AC source (i.e., having a frequency of 50 Hertz as found in Europe or 60 Hertz as found in the United States). In the alternative, the control circuit 8 is designed to be connected to any standard 220 or 440 volt AC source (i.e., having a frequency of 50 or 60 Hertz). The photocell 20 is connected in series with a relay operating coil 22 and the relay switch 14 is connected in series with the light 12. The light 12 is turned off by the relay 10 when the light intensity increases to a certain level and is turned on by the relay 10 when the light intensity decreases to a certain lower level.

Figure 2:
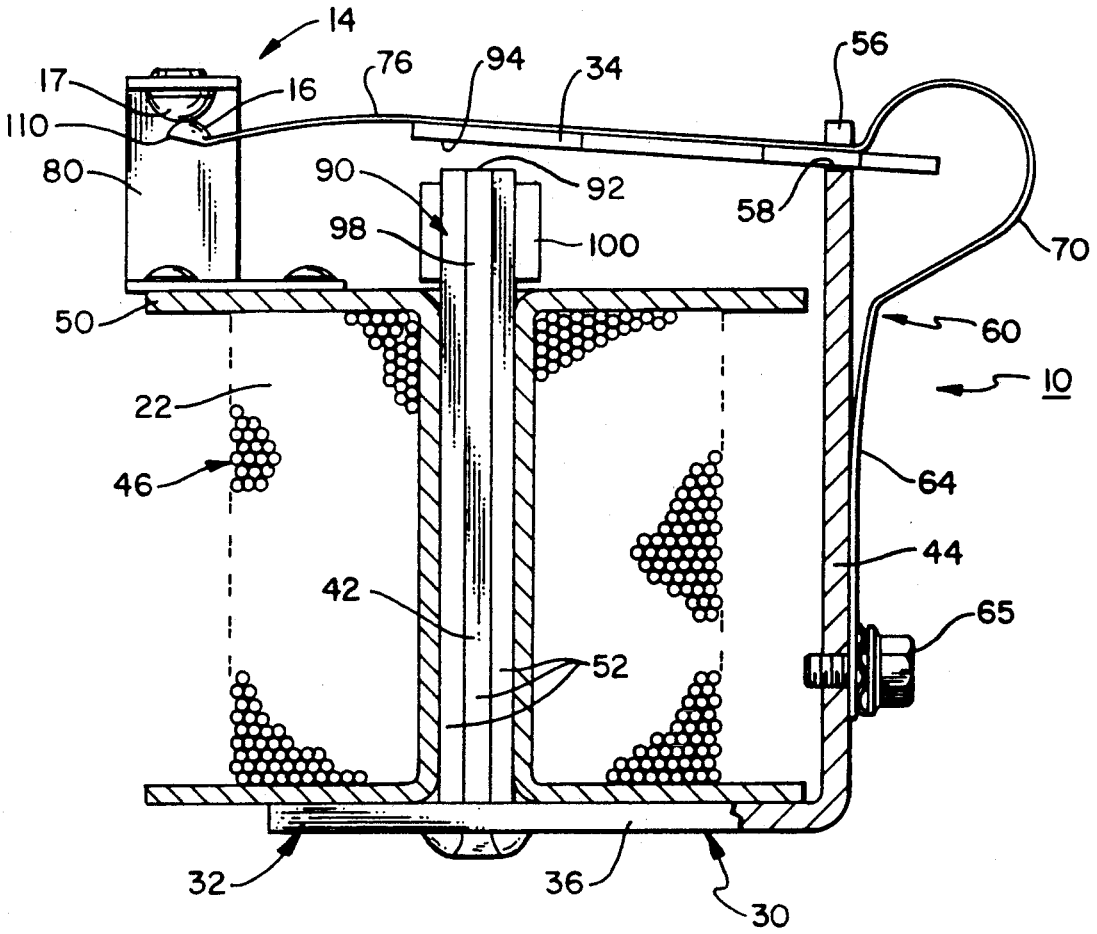
FIG. 2 is a side view, partly broken away and partly in section, of the AC relay.
Figure 3:
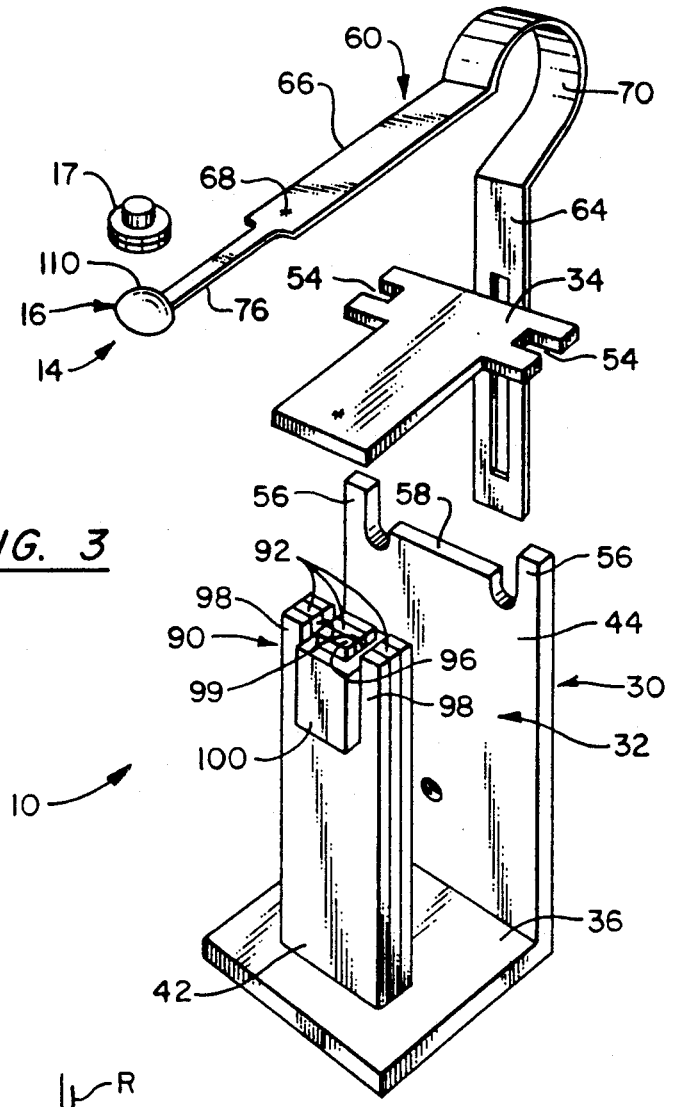
FIG. 3 is a reduced, partly exploded view, partly broken away, of the AC relay.

Referring to FIGS. 2 and 3, the relay 10 has a ferromagnetic structure 30 composed of a generally U-shaped stator core 32 and a pivotal armature or clapper 34. The stator core 32 has a flat base plate 36 and a pair of flat, parallel side plates providing a stator pole plate 42 and a field return plate 44. A coil and coil bobbin subassembly 46 is mounted on the pole plate 42. The coil bobbin subassembly 46 has an opening configured to receive the pole plate 42 and is securely mounted on the pole plate 42 after the coil 22 is wound on the bobbin 50. The flat pole plate 42 is shown composed of three laminations 52 which are suitably insulated (coated) and secured together and to the base plate 36. A non-laminated pole plate (not shown) may be used if desired, in which event the entire U-shaped stator core 32, including the base plate 36 and both side plates 42, 44, is preferably formed from a single stamped metal plate.

The inner end of the clapper 34 and outer end of the field return plate 44 are contoured for pivotally mounting the clapper 34 on the outer end of the plate 44. For that purpose, the inner end of the clapper 34 has a pair of oppositely facing slots 54 and the outer end of the return plate 44 has a pair of upstanding, laterally spaced posts 56 received within the slots 54. A central, outer linear edge 58 of the field return plate 44 is engaged by the flat bottom surface of the clapper 34 to form a pivot edge for the clapper 34. The heel reluctance between the clapper 34 and field return plate 44 remains at a relatively constant, low value throughout the full range of operation of the relay 10 and pivotal movement of the clapper 34.

A leaf spring 60 is formed from an elongated strip stamped from a sheet of suitable, resilient, nonmagnetic material having the desired gauge or thickness. The leaf spring 60 has one flat arm 64 secured by a suitable fastener 65 to the outer face of the field return plate 44 and another flat arm 66 spot welded at 68 to the outer face of the clapper 34. An intermediate arcuate section 70 at the inner or pivotal end of the clapper 34 provides (a) the desired spring bias for returning the clapper 34 to its normal or withdrawn limit position shown in FIG. 2 and (b) the desired spring preload on the clapper 34 in that withdrawn limit position for producing the desired contact force between the electrical contacts 16, 17. The return spring 70 also serves to hold the clapper 34 on the field return plate 44 with the flat bottom face of the clapper 34 in engagement with the pivot edge 58 of the plate 44. The bias provided by the return spring 70 is adjustable by loosening the fastener 65, longitudinally shifting the flat arm 64 under the fastener 65 and then retightening the fastener 65.

The movable contact 16 is provided on the outer end of a cantilevered extension arm 76 of the leaf spring 60 which extends radially outwardly from the outer end of the clapper 34. For the reasons given hereafter, the extension arm 76 is made significantly narrower than the rest of the leaf spring 60 and for example has a width (e.g., 0.125 inches) just slightly greater than one-half the width (e.g., 0.200 inches) of the rest of the leaf spring 60. In its relaxed condition, the extension arm 76 is completely flat except that its outer end is formed into a hemispherical cup to provide the movable contact 16. The outer or convex surface of the movable contact 16 is plated with a suitable silver alloy to improve conductivity. The fixed switch contact 17 is provided on a fixed bracket 80 for engagement by the movable contact 16. The bracket 80 is made of a nonmagnetic material and is suitably fixed to the bobbin 50. The extension arm 76 serves as an overtravel spring and is deflected inwardly slightly as shown in FIG. 2 when the clapper 34 is in its withdrawn limit position.

The outer or free end of the pole plate 42 forms a stator pole 90 with an outer flat linear edge or pole face 92. The stator pole face 92 is engageable by an inner flat pole face 94 at the outer end of the clapper 34. A predetermined (calibrated) working air gap is established between the pole faces 92, 94 when the clapper is in its withdrawn limit position.

The stator pole 90 is divided by one or more elongated slots 99 into a plurality of stator pole segments comprising a shaded or secondary pole segment 96 and one or more primary pole segments 98. In the shown embodiment, two parallel slots 99 are provided which form a primary pole composed of two outer primary pole segments 98 and a shaded pole composed of a central shaded pole segment 96. A suitable shading ring 100 in the form of a solid, rectangular copper ring is mounted on the shaded pole segment 96 and received within the slots 99.

The clapper 34 is a flat stamped metal plate and in the shown embodiment has a relatively narrow, constant width (except for the lateral extensions forming the slots 54) approximately equal to the width of the pole plate 42. Thus, the effective pole face area 94 of the clapper is approximately equal to the total area of the stator pole face 92 plus the transverse area of the two slots 99.

Figure 4:
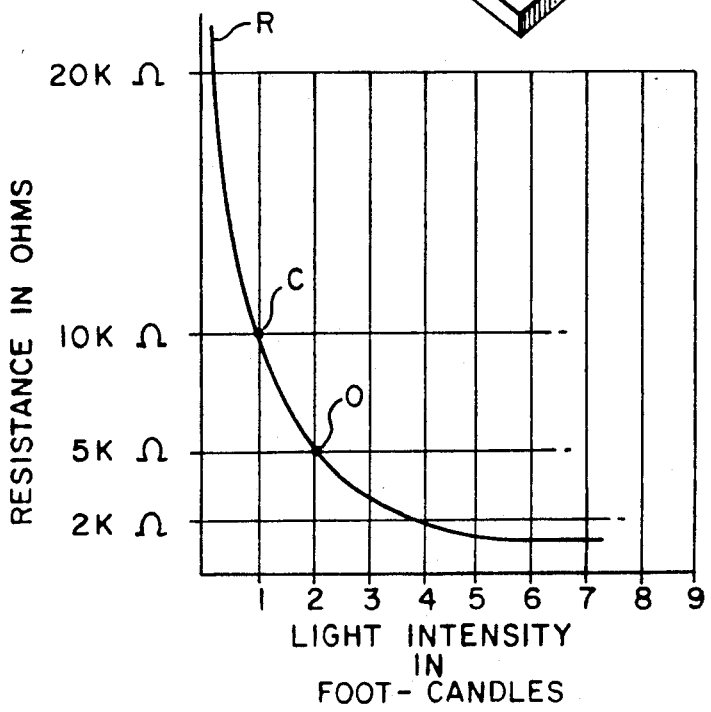
FIG. 4 is a graph illustrating the relationship between the resistance of a photocell of the control circuit and the intensity of light received by the photocell.

FIG. 4 shows a graph having an abscissa scale representing the intensity in foot-candles of the light received by the photocell 20 and an ordinate scale representing the resistance of the photocell 20 in kiloohms. As shown, the photocell resistance R decreases as the light intensity increases. Thus, the AC voltage across the relay coil 22 is directly related to the intensity of the light received by the photocell 20. As the light intensity increases, the AC current ramps upwardly until the relay 10 is actuated. At the relay opening point O, the photocell resistance R has a value at which the AC current is sufficient to actuate the relay 10 and open the switch 14. At the relay closing point C, the AC current has a value at which the relay 10 is reclosed by the clapper return spring 70. The photocell resistance at the closing point C is significantly greater than the resistance at the opening point O so that the AC current at point C is significantly less than that required to open the relay 10 at point O.

The pivotal actuation of the clapper 34 with a sinusoidal AC current is provided by a magnetic field having repeating magnetic cycles corresponding to half-waves of the AC current. Each magnetic cycle lags the corresponding half-wave of the AC current. During each magnetic cycle, three (3) magnetic fields are produced. They are hereafter called the Primary, Secondary and Tertiary Fields. The Primary Field begins when the magnetic cycle begins and lags the corresponding half-wave of the AC current. The Primary Field is the magnetic field through the primary pole (formed by pole segments 98) produced by the AC current and is equal in duration to (but lags) the corresponding half-wave of the AC current. The direction of the Primary Field is dependent on the direction of the AC current.

The Primary Field has first and second phases. The AC current increases rapidly at the beginning of the first phase, reaches its maximum and then decreases rapidly to zero and changes direction before the end of the second phase. During the first phase, the Primary Field provides substantially the total magnetic field across the working air gap. That is so, because, during the first phase of the Primary Field, the induced shading ring current opposes a parallel magnetic field through the shaded pole 96. During the second phase of the Primary Field, the shading ring current produces a parallel magnetic field through the shaded pole 96. This parallel magnetic field through the shaded pole 96 is the Secondary Field referred to above. By definition, the second phase of the Primary Field occurs at the same time as the Secondary Field.

The Secondary Field through the shaded pole 96 helps maintain the magnetic field across the working air gap at a high level as the AC current subsides. The Tertiary Field is produced at the end of each magnetic cycle after the AC current has changed direction and produces a magnetic field in opposition to the Secondary Field. By definition, the Tertiary Field is produced when the field through the shaded pole 96 (produced by the residual current in the shading ring 100) is diverted (by the opposing magnetic field from the AC current) back through the primary pole. A new magnetic circuit between the stator pole 90 and clapper 34 is thereby formed. By definition, the Tertiary Field begins when the direction of the field through the primary pole is reversed. At that point, the two fields produced by the reverse AC current and the residual current in the shading ring 100 pass in the same direction through the primary pole 98. In effect, the Primary Field of the next magnetic cycle begins when the Tertiary Field of the preceding cycle begins. The Tertiary Field ends after the shading ring current is spent and a shading ring current in the reverse direction is induced by the opposing field produced by the AC current. The Tertiary Field occurs during a third and final phase of the magnetic cycle which follows the second phase of the Primary Field. The three described magnetic fields determine the magnetic force on the clapper 34. The amplitude of the magnetic force is determined in part by sizing the relay coil 22 to provide the ampere turns (NI) required to actuate the relay at the desired AC current level.

Figure 5:
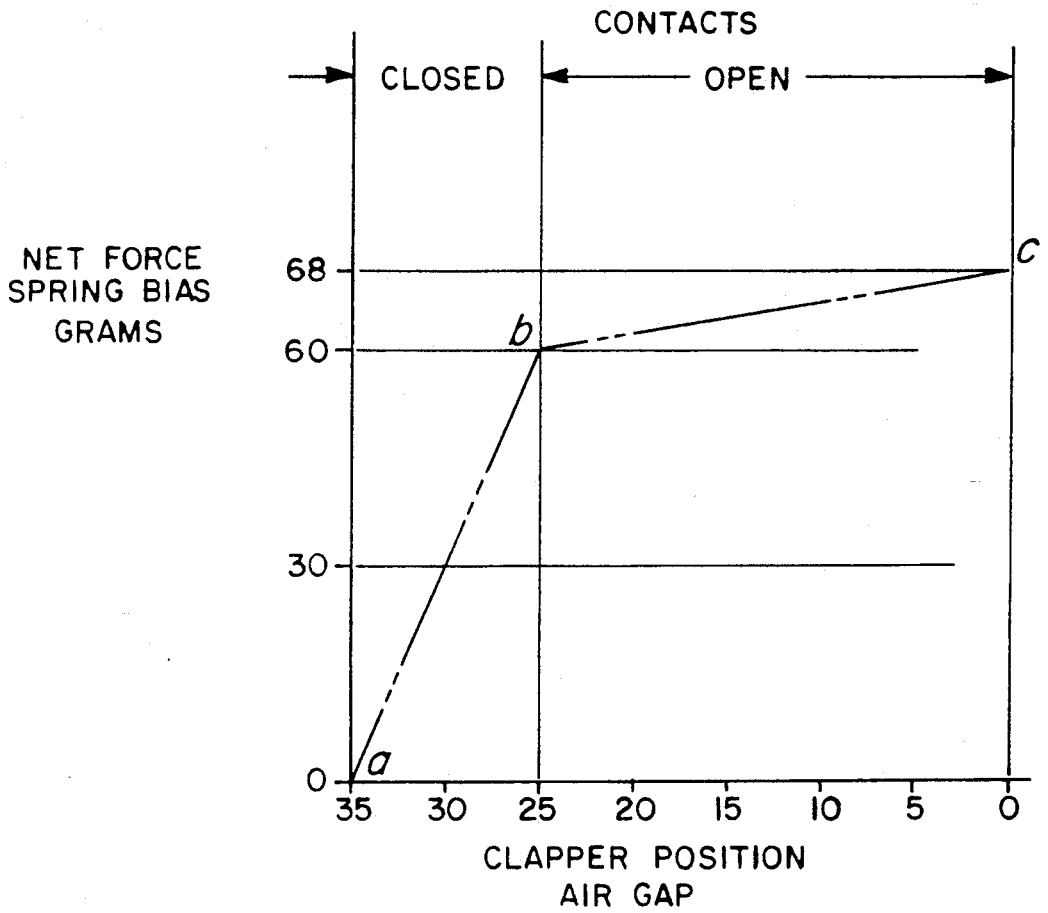
FIG. 5 is a graph illustrating the relationship between the working air gap of a clapper of the relay and the net spring force on the clapper.

FIG. 5 shows a graph having an abscissa scale representing the working air gap or clapper position as the clapper 34 pivots from its withdrawn limit position to its fully actuated position in engagement with the stator pole face 92. The ordinate scale represents the net torsional bias on the clapper produced by the return and overtravel springs 70, 76. The net spring bias is the net of the opening bias produced by the return spring 70 and the opposing or closing bias, if any, produced by the overtravel spring 76. Ignoring inertia, the magnetic force required to hold the clapper at each clapper position is directly proportional to the net spring bias. The net spring bias is zero at point a and increases as the air gap decreases.

In FIG. 5, line a-b represents the relationship between the spring bias and working air gap during the overtravel movement of the clapper 34 between its position at point b (where the switch contacts make or break contact depending on the direction of pivotal movement of the clapper 34) and its fully open or withdrawn limit position at point a. At the intermediate point b, the overtravel spring 76 does not bias the clapper in either direction. At point a, the opposing bias of the overtravel spring arm 76 is the greatest and is equal to the bias of the return spring 70. Line a-b has a relatively steep slope because of the relatively high spring rate of the overtravel spring 76. The area under line a-b represents the work required to pivot the clapper from point a to point b and is a function of the net spring rate (or the spring bias at point b) and the clapper overtravel from point a to point b (e.g., 0.010 inch as shown in FIG. 5).

Line b-c in FIG. 5 represents the relationship of the spring bias and working air gap during clapper movement between its intermediate break position at point b and its fully attracted position at point c in engagement with the stator pole face 92. Line b-c has a relatively flat slope representing the relatively flat spring rate of the return spring 70. The area under line b-c represents the work required to pivot the clapper from point b to point c and is a function of the spring bias at point b, the spring rate of the return spring 70, and the clapper travel between point b and point c (e.g., 0.025 inch as shown in FIG. 5).

Ideally, the spring rate of the return spring 70 is flat. However, a relatively low, positive spring rate as shown in FIG. 5 is acceptable. The spring rate of the overtravel spring 76 is significantly greater, preferably by a factor of at least 10. Also, the work required to pivot the clapper from b to c is significantly greater than the work required to pivot the clapper from a to b (by a factor greater than 5 in the described embodiment).

Figure 6:
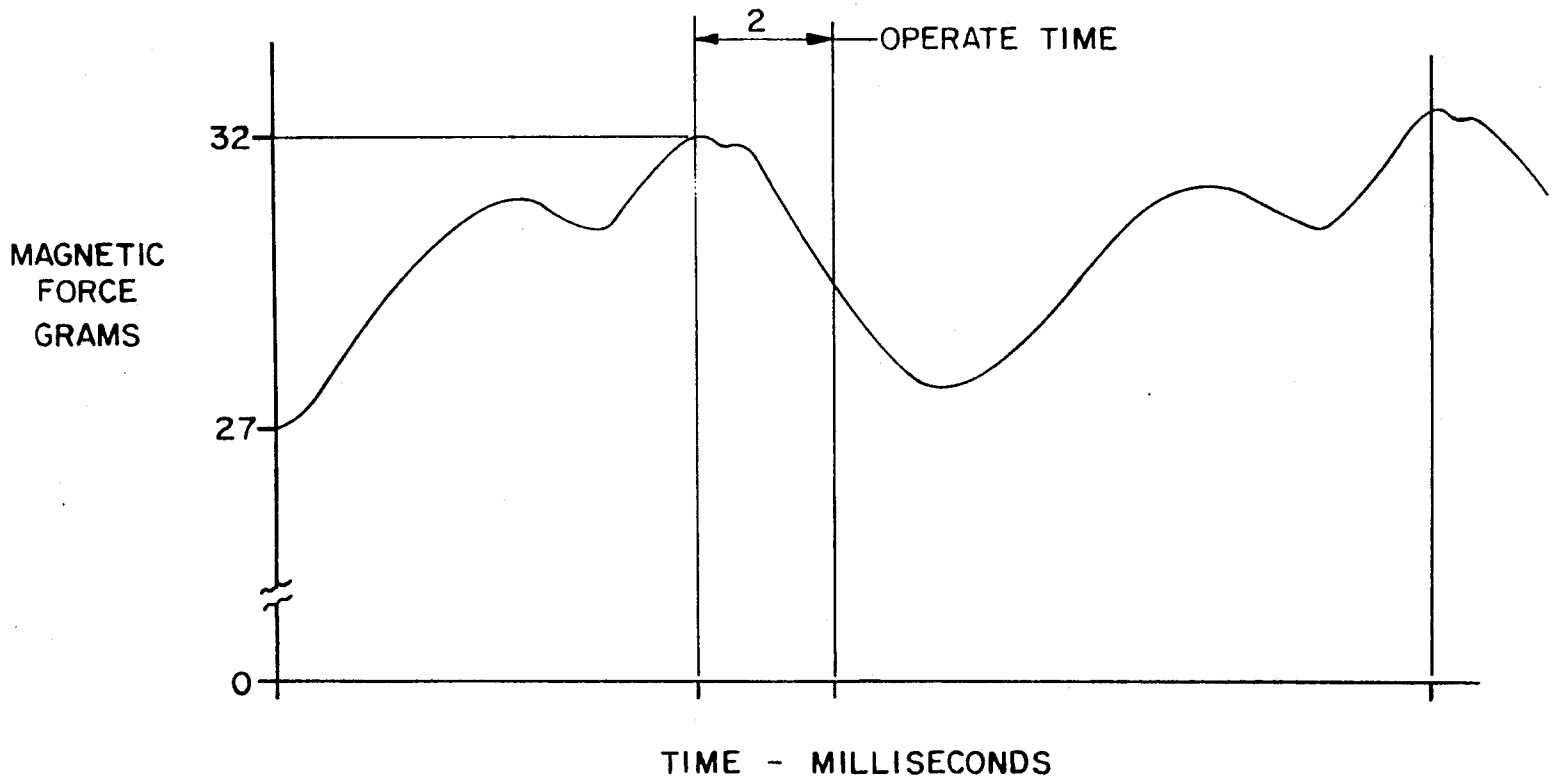
FIG. 6 is a graph illustrating the varying strength of the magnetic field across the working air gap of the clapper at the point the relay contacts break to open the relay.
Figure 7:
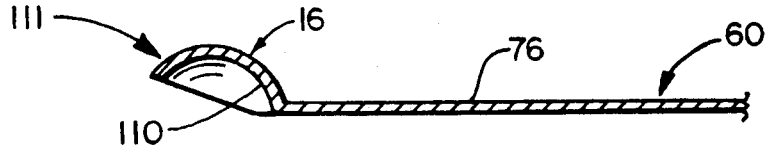
FIG. 7 is an enlarged, longitudinal section view, partly broken away, of a clapper mounted contact arm of the relay having an integrally formed contact.
Figure 8:
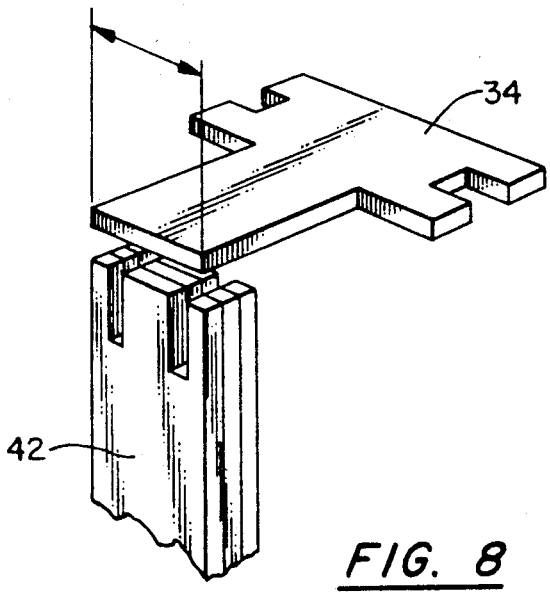
FIG. 8 is a partial perspective view, partly broken away, showing the relative size and physical relationship of the clapper and stator pole of the relay.
Figure 9:
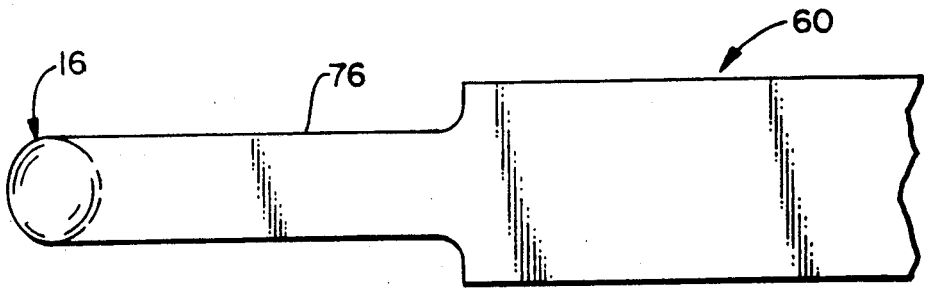
FIG. 9 is an enlarged plan view, partly broken away, of a leaf spring strip of the relay, illustrating the relative widths of the contact arm and remainder of the strip.

FIG. 6 shows a representative graph of the variable magnetic force across the working air gap of the clapper 34 resulting from the Primary, Secondary and Tertiary fields. The variable magnetic force is shown at the point of contact break. The magnitude of the base or minimum magnetic force is not fully represented in FIG. 6 and is several times the base value shown. Two peaks in the magnetic force occur during each magnetic cycle. The first peak is produced by the Primary Field during the first phase of the Primary Field. The second peak is produced during the second phase of the Primary Field by the combination of the Primary and Secondary Fields. The two peaks preferably have approximately the same height so that a relatively constant magnetic force is provided. In FIG. 6, the second peak is shown slightly higher than the first peak. The leading or upward slope of the leading peak and the trailing or downward slope of the trailing peak have a sinusoidal shape closely corresponding to the sinusoidal shape of the applied AC current.

The clapper 34 is made sufficiently responsive in relation to the shape of the variable force at the point of contact break (but before contact break) so that the clapper 34 moves in synchronism with the magnetic force as the magnetic force increases and decreases during each magnetic cycle. The complete clapper assembly (comprising the clapper 34 and the part of the leaf spring 60 which moves with the clapper 34, including the overtravel spring 76 and the movable contact 16) is also made sufficiently responsive in relation to the trailing or downward slope of the higher peak (i.e., the second peak in FIG. 6) so that the rate of decrease in the air gap reluctance as the clapper 34 is attracted toward the stator pole 90 more than offsets the decreasing magnetic field. Also, the overtravel spring assembly (comprising the overtravel spring 76 and the movable contact 16) is made sufficiently responsive in relation to the complete clapper assembly so that the overtravel spring assembly moves in synchronism with the clapper 34. Stated differently, both the clapper assembly and overtravel spring assembly are made sufficiently responsive so that once the contacts are broken at the peak of a magnetic cycle, the clapper 34 is attracted into engagement with the stator pole face 92 before the end of that magnetic cycle.

Preferably, the working air gap at point b (FIG. 5) is approximately 0.025 inch and also approximately two to three times the clapper overtravel from b to a. Stated another way, the clapper overtravel is preferably approximately 0.010 inch and approximately equal to but greater than one-fourth the total clapper travel (e.g., 0.035 inch). As is well known, the reluctance of the working air gap is proportional to the second power of the air gap. Thus, the average rate of change of reluctance during the overtravel movement is somewhat less than the rate of change at b, and the rate of change increases rapidly as the clapper 34 is pivoted from b to c.

As described, the overtravel spring 76 has a width approximately one-half the width of the rest of the leaf spring 60. This reduction in width reduces the weight of the overtravel spring 76 and thereby substantially reduces the moment of inertia of both the overtravel spring assembly and the complete clapped assembly and also substantially reduces the radius of gyration of the complete clapper assembly. For the same reason (i.e., to reduce the moment of inertia of both the overtravel spring assembly and the complete clapper assembly and reduce the radius of gyration of the complete clapper assembly), the movable contact 16 is provided by forming a low weight, hemispherical cup on the outer end of the overtravel spring 76.

The stiffness or spring rate of the overtravel spring 76 is proportional to the third power of its thickness whereas the moment of inertia of the overtravel spring 76 is proportional to its weight. A stiff overtravel spring 76 having a substantially reduced weight is provided by substantially decreasing its width and by slightly increasing the thickness of the leaf spring 60. The moment of inertia and radius of gyration of the clapper assembly are thereby substantially reduced. Of equal or even greater significance is that the moment of inertia of the overtravel spring 76 is greatly reduced to ensure that the overtravel spring 76 moves in synchronism with the clapper 34. That is, the overtravel spring 76 is flat or unflexed or nearly so when contact break occurs and remains essentially in that condition as the clapper 34 moves from the contact break position toward the stator pole face 92. In the shown embodiment, the overtravel spring 76 has a width of 0.125 inches and a thickness of 0.007 inches. Also, the length of the pivotal clapper 34 is preferably reduced to further reduce the moment of inertia and radius of gyration of both the overtravel spring 76 and complete clapper assembly. In the described embodiment, a clapper 34 having a length of 0.600 inch between its pivot axis and outer end has been found acceptable.

The described configuration of the clapper 34 and overtravel spring 76, in combination with the described spring rates of the return spring 70 and overtravel spring 76 and the relative sizes of the working air gap and clapper overtravel collectively provide a clapper operation which prevents, or at least substantially reduces, incipient switch chatter when the relay is opened. This is accomplished without using special ferromagnetic alloys in the construction of the clapper 34 or stator core 32.

In the described embodiment, the clapper 34 is magnetically attracted from its intermediate contact break position (i.e., point b in FIG. 5) into engagement with the stator pole face 92 within significantly less than one-half of the 50 or 60 Hertz AC operating cycle (i.e., significantly less than 10.0 or 8.3 milliseconds or 1/100 or 1/120 of a second respectively). Specifically, in the described embodiment, such clapper movement takes approximately 1.5 milliseconds. This operating time is achieved (a) by reducing the moment of inertia of the overtravel spring assembly and (b) by reducing the moment of inertia and radius of gyration of the complete clapper assembly. Both reductions are realized in large part by reducing the weight of the overtravel spring 76. Those reductions and the provision of (c) an overtravel spring 76 with a spring rate greater than that of the return spring 70 by a significant factor (e.g., by a factor greater than 5 and preferably approximately 10 or more; and (d) a relationship of clapper overtravel and working air gap generally as described, increases the responsiveness of the clapper 34 prior to contact break so that both the clapper 34 and overtravel spring 76 are in synchronism with the magnetic field immediately prior to contact break.

The described configuration provides for increasing the natural frequency of both the overtravel spring 76 and the complete clapper assembly (both before and after contact break) so that their natural frequencies are significantly greater than the fundamental frequency of the magnetic field (i.e., significantly greater than twice the line frequency of the AC source). In the described embodiment, the natural frequency of the complete clapper assembly during clapper overtravel is probably in the range of 5–10 times the line frequency. The natural frequency of just the overtravel spring assembly is probably greater. Accordingly, both the clapper assembly and overtravel spring 76 are sufficiently responsive to move in synchronism with the changing magnetic force across the working air gap as the magnetic field varies during each magnetic cycle. Thus, as the magnetic field increases to a level insufficient to open the switch, the clapper 34 and overtravel spring 76 will pivot in synchronism with the magnetic field and will not overshoot and cause switch chatter. That is, the pivotal movement of the clapper 34 will be the greatest when the field strength is the greatest and the overtravel spring 76 will move in synchronism with the clapper 34. Thus, normally the clapper 34 will be magnetically attracted to break contact as the strength of the magnetic field is increasing and not decreasing.

The natural frequency of the clapper assembly decreases after contact break because the bias of the overtravel spring 76 is no longer a factor. Also, after contact break, the entire overtravel spring 76, including the movable contact 16, moves with the rest of the clapper assembly to increase the radius of gyration and moment of inertia of the clapper assembly. This increase is minimized so that the natural frequency of the clapper assembly remains high enough after contact break to ensure that the clapper assembly is rapidly attracted into engagement with the stator pole face 92.

Thus, avoidance of switch chatter is accomplished by ensuring that the clapper 34 and overtravel spring 76 move in synchronism with the magnetic field at the point of contact break. As a consequence, the field strength normally will be increasing at the point of contact break. After contact break, the high natural frequency and low moment of inertia of the clapper assembly, the rapid decrease in air gap reluctance and the relatively flat spring rate of the return spring 70 together help ensure that the clapper is rapidly pivoted into engagement with the stator pole face 92. A snap or overcenter-like action is thereby achieved.

As will be apparent to persons skilled in the art, various modifications, adaptations and variations of the foregoing specific disclosure can be made without departing from the teachings of the present invention.

I claim:

1. In an AC relay operable by an AC source and having a ferromagnetic structure with a stator core with primary and shaded poles providing primary and secondary pole faces respectively and a pivotal clapper having a pole face at the outer end thereof in opposed face to face relationship with the primary and secondary pole faces, an elongated leaf spring fixed to the clapper and providing a clapper overtravel spring extending radially outwardly from the outer end of the clapped and a clapper return spring at the other end of the clapper biasing the clapper from fully attracted to fully withdrawn pivotal positions thereof, a fixed relay contact, a movable relay contact on the outer end of the overtravel spring in engagement with the fixed contact as the clapper moves between its fully withdrawn position and a contact break position intermediate its fully withdrawn and fully attracted positions, an operating coil mounted on the stator core for producing an electromagnetic field through the ferromagnetic structure and across a working air gap between the opposed pole faces to magnetically attract the clapper in one direction thereof from its fully withdrawn to its fully attracted position against the net bias of the return and overtravel springs, the return and overtravel springs providing an equal and opposite preload bias on the clapper at its fully withdrawn position; the improvement wherein the overtravel spring has a width and weight so that both the overtravel spring assembly, comprising the overtravel spring and movable contact, and the clapper assembly, comprising the clapper and the part of the leaf spring, including the overtravel spring assembly, which moves with the clapper, have a natural frequency significantly greater than twice the operating frequency of the AC source and so that the clapper is magnetically attracted from its intermediate contact break position to its fully attracted position in significantly less than one-half the operating cycle of the AC source.

2. An AC relay according to claim 1 wherein the overtravel spring assembly and clapper assembly each have a natural frequency greater than the operating frequency of the AC source by a factor of at least 5.

3. An AC relay according to claim 1 wherein the clapper is magnetically attracted from its intermediate contact break position to its fully attracted position in at least approximately one-tenth of an operating cycle of the AC source.

4. An AC relay according to claim 1 wherein the overtravel spring has a width significantly less than the width of the return spring.

5. An AC relay according to claim 1 wherein the movable contact is provided by a hemispherical cup formed on the outer end of the overtravel spring.

6. In an AC relay operable by an AC source and having a ferromagnetic structure with a stator core with primary and shaded poles providing primary and secondary pole faces respectively and a pivotal clapper having a pole face at the outer end thereof in opposed face to face relationship with the primary and secondary pole faces, an elongated leaf spring fixed to the clapper providing a clapper overtravel spring extending outwardly from the outer end of the clapper and a clapper return spring at the other end of the clapper biasing the clapper from fully attracted to fully withdrawn pivotal positions thereof, a fixed relay contact, a movable relay contact on the outer end of the overtravel spring in engagement with the fixed contact as the clapper moves between its fully withdrawn position and a contact break position intermediate its fully withdrawn and fully attracted positions, the overtravel spring having a spring rate significantly greater than the spring rate of the return spring, an operating coil mounted on the stator core for producing an electromagnetic field through the ferromagnetic structure and across a working air gap between the opposed pole faces to magnetically attract the clapper in one pivotal direction thereof from its withdrawn to its attracted position against the net bias of the return and overtravel springs; the improvement wherein both the overtravel spring assembly, comprising the overtravel spring and movable contact, and the clapper assembly, comprising the clapper and the part of the leaf spring, including the overtravel spring assembly, which moves with the clapper, have a natural frequency significantly greater than twice the operating frequency of the AC source and wherein the clapper is magnetically attracted from its intermediate contact break position to its fully attracted position in significantly less than one-half the operating cycle of the AC source.

7. An AC relay according to claim 6 wherein the working air gap at the fully withdrawn position of the clapper is greater than the working air gap differential between the fully withdrawn and intermediate contact break positions of the clapper by a factor between 3 and 4.

8. An AC relay according to claim 6 wherein the overtravel spring has a spring rate which is greater than the spring rate of the return spring by a factor of at least approximately 10.

9. An AC relay according to claim 6 wherein the overtravel spring assembly and clapper assembly each have a natural frequency greater than the operating frequency of the AC source by a factor of at least 5.

10. An AC relay according to claim 6 wherein the overtravel spring has a width substantially less than the width of the return spring.

11. A method of operating an AC relay comprising the steps of providing a normally closed AC relay having a ferromagnetic structure with a stator core with a stator pole face and a pivotal clapper having a clapper pole face at the outer end thereof in opposed face to face relationship with the stator pole face, a clapper return spring biasing the clapper from fully attracted to fully withdrawn pivotal positions thereof and a leaf-type clapper overtravel spring mounted on the clapper and extending radially outwardly therefrom, a fixed relay contact, a movable relay contact on the outer end of the overtravel spring in engagement with the fixed contact as the clapper moves between its fully withdrawn position and a contact break position intermediate its fully withdrawn and fully attracted positions, an operating coil mounted on the stator core for producing an electromagnetic field through the ferromagnetic structure and across a working air gap between the opposed pole faces to magnetically attract the clapper in one direction thereof from its fully withdrawn to its fully attracted position against the net bias of the return and overtravel springs; providing an AC source of predetermined frequency and voltage; applying the AC source to the operating coil with the applied voltage gradually increasing through a level required to pivot the clapper to its fully attracted position; and configuring the overtravel spring assembly, comprising the overtravel spring and movable contact, and the clapper assembly, comprising the clapper and overtravel spring assembly, to have a natural frequency significantly greater than twice the operating frequency of the AC source so that the clapper is magnetically attracted from its intermediate contact break position to its fully attracted position in significantly less than one-half the operating cycle of the AC source.

12. A method of operating an AC relay according to claim 11 wherein both the overtravel spring assembly and clapper assembly are configured to have a natural frequency greater than the operating frequency of the AC source by a factor of at least 5.

13. A method of operating an AC relay according to claim 11 wherein the overtravel spring has a spring rate which is greater than the spring rate of the return spring by a factor of at least approximately 10.

14. A method of operating an AC relay according to claim 11 wherein the overtravel spring extends radially outwardly from the outer end of the clapper.

15. A method of operating an AC relay according to claim 11 wherein the overtravel spring assembly is configured to have a natural frequency greater than the natural frequency of the clapper assembly.

16. In an AC relay operable by an AC source and having a ferromagnetic structure with a stator core with primary and shaded poles providing primary and secondary pole faces respectively and a pivotal clapper having a pole face at the outer end thereof in opposed face to face relationship with the primary and secondary pole faces, an elongated leaf spring fixed to the clapper and providing a clapper overtravel spring extending radially outwardly from the outer end of the clapper and a clapper return spring at the other end of the clapper biasing the clapper from fully attracted to fully withdrawn pivotal positions thereof, a fixed relay contact, a movable relay contact on the outer end of the overtravel spring in engagement with the fixed contact as the clapper moves between its fully withdrawn position and a contact break position intermediate its fully withdrawn and fully attracted positions, an operating coil mounted on the stator core for producing an electromagnetic field through the ferromagnetic structure and across a working air gap between the opposed pole faces to magnetically attract the clapper in one direction thereof from its fully withdrawn to its fully attracted position against the net bias of the return and overtravel springs, the return and overtravel springs providing an equal and opposite preload bias on the clapper in its withdrawn position, the improvement wherein said overtravel spring has a width significantly less than the width of the return spring to reduce the moment of inertia of both the overtravel spring assembly, comprising the overtravel spring and movable contact, and the clapper assembly, comprising the clapper and the part of the leaf spring, including the overtravel spring assembly, which moves with the clapper, and to reduce the radius of gyration of the clapper assembly.

* * * * *